US009665019B2

(12) United States Patent
Suzuki et al.

(10) Patent No.: US 9,665,019 B2
(45) **Date of Patent: *May 30, 2017**

(54) ELECTROPHOTOGRAPHIC PHOTOCONDUCTOR, PRODUCTION METHOD THEREOF, AND ELECTROPHOTOGRAPHIC APPARATUS

(71) Applicant: FUJI ELECTRIC CO., LTD., Kawasaki-shi (JP)

(72) Inventors: Shinjiro Suzuki, Matsumoto (JP); Ikuo Takaki, Matsumoto (JP); Seizo Kitagawa, Matsumoto (JP); Hiroshi Emori, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,756

(22) Filed: Aug. 10, 2015

(65) Prior Publication Data

US 2015/0346614 A1 Dec. 3, 2015

Related U.S. Application Data

(63) Continuation of application No. PCT/JP2014/068631, filed on Jul. 11, 2014.

(30) Foreign Application Priority Data

Jul. 16, 2013 (WO) ..... PCT/JP2013/069254

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/0517* (2013.01); *G03G 5/0521* (2013.01);
(Continued)

(58) Field of Classification Search
CPC ..... G03G 5/14708; G03G 5/14713; G03G 5/14721
(Continued)

(56) References Cited

U.S. PATENT DOCUMENTS 5,213,924 A 5/1993 Sakamoto
2010/0028791 A1 2/2010 Takaki et al.
(Continued)

FOREIGN PATENT DOCUMENTS

JP S61-62040 A 3/1986
JP H03-273256 A 12/1991
(Continued)

OTHER PUBLICATIONS

Office Action dated Aug. 2, 2016 for the corresponding Japanese Application No. 2015-527284.
(Continued)

*Primary Examiner* — Mark A Chapman
(74) *Attorney, Agent, or Firm* — Rabin & Berdo, P.C.

(57) ABSTRACT

An electrophotographic photoconductor includes a conductive support; a charge generation layer provided on the conductive support; and a charge transport layer containing a charge transport material, a binder resin, and a highly branched polymer having a long-chain alkyl group or an alicyclic group, provided on the charge generation layer as an outermost layer. The electrophotographic photoconductor has excellent contamination resistance against sebum or the like, stable electrical characteristics even upon repeated use, as well as superior transfer resistance and gas resistance. A method for producing the electrophotographic photoconduc-
(Continued)

tor is disclosed, as well as an electrophotographic apparatus including the electrophotographic photoconductor.

8 Claims, 3 Drawing Sheets

(51) Int. Cl.
*G03G 5/147* (2006.01)
*G03G 5/05* (2006.01)

(52) U.S. Cl.
CPC ..... *G03G 5/0546* (2013.01); *G03G 5/0592* (2013.01); *G03G 5/14708* (2013.01); *G03G 5/14713* (2013.01); *G03G 5/14721* (2013.01)

(58) Field of Classification Search
USPC ..... 430/66
See application file for complete search history.

(56) References Cited

U.S. PATENT DOCUMENTS

| | | | |
|---|---|---|---|
| 2013/0022904 | A1 | 1/2013 | Zhu et al. |
| 2014/0088216 | A1 | 3/2014 | Matsuyama et al. |

FOREIGN PATENT DOCUMENTS

| | | | |
|---|---|---|---|
| JP | H04-179961 | A | 6/1992 |
| JP | 2001-353808 | A | 12/2001 |
| JP | 2003-228184 | A | 8/2003 |
| JP | 2003-255580 | A | 9/2003 |
| JP | 2004-085644 | A | 3/2004 |
| JP | 2004-354759 | A | 12/2004 |
| JP | 2006-047344 | A | 2/2006 |
| JP | 2006-106772 | A | 4/2006 |
| JP | 2007-279446 | A | 10/2007 |
| JP | 2010-024330 | A | 2/2010 |
| JP | 2010-276699 | A | 12/2010 |
| JP | 2011-064734 | A | 3/2011 |
| JP | 2011-203495 | A | 10/2011 |
| JP | 2012-093403 | A | 5/2012 |
| JP | 2013-050559 | A | 3/2013 |
| JP | 2013-057904 | A | 3/2013 |
| WO | WO-2011/108064 | A1 | 9/2011 |
| WO | WO-2012/128214 | A1 | 9/2012 |

OTHER PUBLICATIONS

International Search Report received in PCT/JP2013/069254 on Jul. 16, 2013.

ELECTROPHOTOGRAPHIC PHOTOCONDUCTOR, PRODUCTION METHOD THEREOF, AND ELECTROPHOTOGRAPHIC APPARATUS

CROSS-REFERENCE TO RELATED APPLICATIONS

This non-provisional application for U.S. Letters Patent is a Continuation of International Application PCT/JP2014/068631 filed Jul. 11, 2014, which claims priority from International Application PCT/JP2013/069254 filed Jul. 16, 2013, the entire contents of both of which are hereby incorporated by reference.

BACKGROUND OF THE INVENTION

1. Field of the Invention

The present invention relates to an electrophotographic photoconductor that is used in electrophotographic printers, copiers, fax machines and the like (hereafter also referred to simply as "photoconductor"), to a method for producing the electrophotographic photoconductor, and to an electrophotographic apparatus. More particularly, the present invention relates to an electrophotographic photoconductor that, by containing a polymer of specific structure, exhibits excellent contamination resistance, electrical characteristic stability, and ozone resistance, to a method for producing the electrophotographic photoconductor, and to an electrophotographic apparatus.

2. Background of the Related Art

The electrophotographic photoconductor has a basic structure wherein a photoconductive layer having a photoconductive function is disposed on a conductive support. Ongoing research and development are actively carried out on organic electrophotographic photoconductors that utilize organic compounds as functional components for charge generation and transport, given the advantages that organic electrophotographic photoconductors afford, such as material diversity, high productivity, safety and the like. The use of organic electrophotographic photoconductors in copiers, printers and the like is thus becoming more widespread.

Generally, a photoconductor must fulfill the function of holding surface charge in the dark, generating charge when receiving light, and transporting the charge thus generated. Such photoconductors encompass so-called single layer-type photoconductors that are provided with a single photoconductive layer that combines the above functions, and so-called multilayer-type (of function-separated type) photoconductors provided with a photoconductive layer that is a stack of layers functionally separated into a charge generation layer that fulfils mainly the function of charge generation upon reception light, and a charge transport layer that fulfils the function of transporting the charge that is generated in the charge generation layer upon reception of light.

The above photoconductive layers are generally formed by coating a conductive support with a coating solution in which a charge generation material, a charge transport material and a binder resin are dissolved or dispersed in an organic solvent. In many instances a polycarbonate is used as the binder resin in organic electrophotographic photoconductors, in particular in the outermost surface layer, since polycarbonates are resistant to friction with paper and with blades for toner removal, and boast excellent flexibility and good exposure transparency. Among the foregoing, bisphenol Z polycarbonates are widely used as the binder resin.

Technologies in which such polycarbonates are used as a binder resin include, for instance, Japanese Patent Application Publication No. S61-62040 (Patent literature 1).

Electrophotographic printing devices are required to possess ever higher durability and sensitivity, and faster responses, to cope with, for instance, increases in the number of prints to be printed in a networked office, and with the rapid development of lightweight electrophotographic printing machines. These devices, moreover, are held to strict requirements in terms of being little affected by gases, such as ozone and NOx that are generated in the device, and exhibiting little fluctuation in image characteristics arising from variations in the usage environment (room temperature and humidity).

Recent developments in color printers, and the growing prevalence of the latter, have been accompanied with a need for higher printing speeds, smaller equipment and fewer constituent members, as well as the need for accommodating various usage environments. Under such circumstances, there is a pressing demand for photoconductors that exhibit little variation in image characteristics and electrical characteristics caused by repeated use and/or derived from fluctuations in the usage environment (room temperature and environment). Conventional technologies have thus far failed to meet these requirements simultaneously to a sufficient degree.

Ozone is a widely known example of a gas that is generated in equipment. Ozone is generated by a charger or roller charger that triggers corona discharge. The photoconductor becomes thus exposed to residual ozone or dwelling ozone within the equipment. It is found that the organic substances that make up the photoconductor become oxidized thereby, and, as a result, the original structure of the photoconductor breaks down, and the photoconductor characteristics are significantly impaired. Moreover, it is found that ozone oxidizes the nitrogen in air into NOx, which in turn alters the organic substances that make up the photoconductor.

It is deemed that not only does characteristic deterioration elicited by such gases extend to the outermost layer of the photoconductor, but also adverse effects arise when the gas flows into the interior of the photoconductive layer. It is found that the outermost layer itself of the photoconductor is scraped off, though slightly, on account of friction with the above-described various members. When a harmful gas flows into the interior of the photoconductive layer, the organic substances in the photoconductive layer may undergo structural breakdown. Suppressing the inflow of such harmful gas is thus an issue to be addressed. In tandem-type color electrophotographic apparatuses that rely on a plurality of photoconductors, in particular, variation in color tone occurs as a result of differences in the degree of influence of the gas, depending on, for instance, the position at which drums are disposed in the device. Such variations are deemed to constitute an impediment to forming adequate images. Therefore, it is found that characteristic deterioration caused by gas is a particularly important issue in tandem-type color electrophotographic apparatuses.

The photoconductor surface may also be contaminated by ozone, nitrogen oxides and the like that are generated during charging of the photoconductor. Problems that arise in such a case include, for instance, image smearing by those contaminants themselves, as well as lowered surface lubricity caused by the adhered substances, greater likelihood of adhesion of paper dust and toner, and likelier occurrence of blade squealing, curling, surface scratches and the like.

It is also found that human sebum and the like becomes adhered to the photoconductor surface during repair of the electrophotographic apparatus and during the operation of replacing photoconductor units. Thus far, however, the durability of photoconductors against such contaminant adhesion has been not necessarily sufficient, and surface cracks, as well as image defects such as white spots and black spots occur in some instances when human nose fat or scalp sebum is left adhered to the surface of the photoconductor over long periods of time.

Various methods for improving the outermost surface layer of photoconductors have been proposed in order to solve the above problems. Specifically, various polycarbonate resin structures have been proposed in order to enhance the durability of photoconductor surfaces. For instance, Japanese Patent Application Publication No. 2004-354759 (Patent literature 2) and Japanese Patent Application Publication No. H04-179961 (Patent literature 3) propose polycarbonate resins that comprise a specific structure, but not enough consideration is given to compatibility with various charge transport agents and various additives, or to resin solubility. For instance, Japanese Patent Application Publication No. 2004-85644 (Patent literature 4) proposes a polycarbonate resin that comprises a specific structure; however, a resin having a highly bulky structure includes large spaces between polymers, and thus substances released during charging, as well as contact members and foreign matter, permeate readily into the photoconductive layer, and it is accordingly difficult to achieve sufficient durability. Japanese Patent Application Publication No. H03-273256 (Patent literature 5) proposes a polycarbonate having a special structure, in order to enhance printing durability and coatability, but does not sufficiently disclose additives or charge transport materials that are combined with the polycarbonate. Patent literature 5 is problematic in that maintaining stable electrical characteristics over long periods of time is difficult.

Japanese Patent Application Publication No. 2010-276699 (Patent literature 6) proposes the feature of adding a highly branched polymer and a polymerizable charge transport agent to a surface protective layer, to enhance thereby abrasion properties and transfer properties, but coating solution stability is still an issue. Japanese Patent Application Publication No. 2003-255580 (Patent literature 7) proposes the feature of incorporating, into the surface layer of the photoconductor, a binder resin and a linear vinyl polymer having long-chain alkyl groups at side chains. However, it is found that upon polymerization of a vinyl polymer in a solution in the presence of another binder resin, it is difficult to control the molecular weight and the resin skeleton, due to presence of that other resin. Regarding improvements in wear resistance by a surface protective layer, Japanese Patent Application Publication No. 2011-64734 (Patent literature 8) proposes a technology that involves configuring a surface protective layer that contains a cured product having a three-dimensional crosslinked structure and formed out of a predetermined radically polymerizable compound, a trifunctional or higher functional radically polymerizable monomer, and a radically polymerizable compound having a charge transporting structure, but this configuration is problematic in terms of productivity, since the photoconductive layer has a multilayer structure. Improvements derived from the charge transport layer are an important issue herein.

Transfer current tends to increase in color printers on account of toner color overlap and/or the use of transfer belts. When printing on paper of various sizes, a difference in transfer fatigue arises between portions with paper and portions without paper. This in turn exacerbates differences in image density, which is problematic. In case of frequent printing on small-sized paper, bare photoconductor portions over which the paper does not pass (paper non-passage sections) are continuously and directly affected by transfer, and exhibit greater transfer fatigue than bared photoconductor portions over which paper does pass (paper passage sections). As a result, when printing is subsequently performed on large-size paper, the above discrepancy in transfer fatigue between paper passage sections and paper non-passage sections gives rise to a potential difference in the developed area, which translates into observable differences in density. This trend becomes yet more pronounced as transfer current increases. Under such circumstances, the demand has intensified for photoconductors that exhibit little fluctuation in image characteristics and electric characteristics as a result of repeated use, or on account of fluctuations in the usage environment (room temperature and environment), and that exhibit excellent transfer resiliency, particularly in color printer, as compared to monochrome printers. Conventional technologies have thus far failed to meet these requirements simultaneously to a sufficient degree.

Various additives, such as hindered phenol compounds, phosphorus compounds, sulfur compounds, amine compounds, hindered amine compounds and the like have been proposed to enhance gas resistance. The current situation, however, is that these technologies fail to provide sufficient gas resistance, or, even if satisfactory characteristics are exhibited in terms of gas resistance, no satisfactory results are achieved, through a combination of resins and charge transport materials, regarding electrical characteristics, for instance, responsiveness, image memory and potential stability in endurance printing. The applicants had proposed diester compounds in WO 2011/108064 (Patent literature 9) and Japanese Patent Application Publication No. 2007-279446 (Patent literature 10), but have since made further progress in the study of combinations of more appropriate binder resins and high-mobility charge transport materials.

Various conventional technologies have been proposed pertaining to improvement of the surface layer of photoconductors. However, these technologies as disclosed in the citations above were not all sufficient as regards electrical characteristics such as light response, and also contamination resistance towards sebum, photoconductor productivity and the like.

Therefore, it is an object of the present invention to provide an electrophotographic photoconductor that has excellent contamination resistance and stable electrical characteristics and so forth upon repeated use, and superior transfer resistance and gas resistance, and to provide a method for producing the electrophotographic photoconductor, and an electrophotographic apparatus.

SUMMARY OF THE INVENTION

As a result of diligent research on the composition of photoconductor layers, with a view to solving the above problems, the inventors found that dissolving a highly branched polymer of specific structure in a coating solution of an outermost layer of the photoconductor, and applying the outermost layer with the highly branched polymer in a state of being dispersed in the coating solution, makes it possible to realize an electrophotographic photoconductor having excellent contamination resistance and superior electrical characteristics, and in which a highly branched polymer can be incorporated into the outermost layer of the electrophotographic photoconductor, and perfected the present invention on the basis of that finding.

Specifically, the electrophotographic photoconductor of the present invention is an electrophotographic photoconductor comprising: a conductive support; a charge generation layer provided on the conductive support; and a charge transport layer containing a charge transport material, a binder resin, and a highly branched polymer having a long-chain alkyl group or an alicyclic group, provided on the charge generation layer as an outermost layer.

In the present invention, a modifier in the form of a lipophilic highly branched polymer obtained through introduction of a long-chain alkyl group or an alicyclic group is dissolved, in addition to a functional material, a binder resin and the like, into a coating solution for charge transport layer, as the outermost layer of a photoconductor; as a result, it becomes possible to cause the highly branched polymer to segregate at the surface in the charge transport layer. A branched structure is actively introduced into the highly branched polymer, and hence the highly branched polymer exhibits characteristically a lower degree of molecule entanglement than linear polymers, and exhibits a microparticle-like behavior, with high dispersibility in resins. Specifically, such a highly branched polymer is obtained by polymerizing, in the presence of an azo-based polymerization initiator, a monomer having, in the molecule, two or more radically polymerizable double bonds, and a monomer having, the molecule, a long-chain alkyl group or an alicyclic group and at least one radically polymerizable double bond. Specifically, such a highly branched polymer can be obtained by polymerizing a monomer (A) and a monomer (B) in the presence of an azo-based polymerization initiator (C), the monomer (A) having, in the molecule, two or more radically polymerizable double bonds, and the monomer (B) having, the molecule, an alkyl group having 6 to 30 carbon atoms or an alicyclic group having 3 to 30 carbon atoms, and at least one radically polymerizable double bond.

A method for producing the electrophotographic photoconductor according to the present invention comprises: providing a coating solution for the charge transport layer containing the charge transport material, the binder resin and the highly branched polymer having a long-chain alkyl group or an alicyclic group; and coating the coating solution onto the charge generation layer.

The electrophotographic apparatus of the present invention is characterized by being equipped with the electrophotographic photoconductor of the present invention. The electrophotographic apparatus of the present invention can be further provided with a charging device and a developing device.

By virtue of the above features, the present invention succeeds in realizing an electrophotographic photoconductor excellent in electrical characteristic stability, transfer resistance and gas resistance, and of good environment characteristic, and in which contamination resistance towards sebum on the photoconductor surface is enhanced, through addition of the highly branched polymer of specific structure above to the outermost layer of the photoconductor, and succeeds in realizing a method for producing the electrophotographic photoconductor, and an electrophotographic apparatus.

DETAILED DESCRIPTION OF THE INVENTION

Embodiments of the present invention will be explained next in detail with reference to accompanying drawings. The present invention is not limited in any way to the explanation below.

Figure 1:
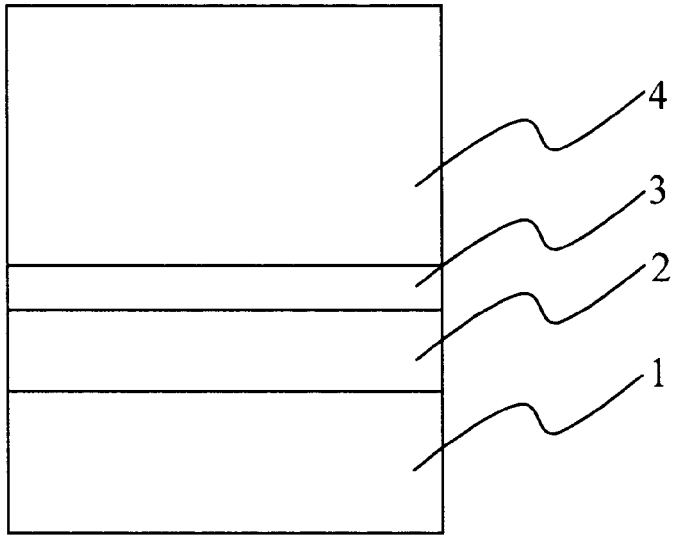
FIG. 1 is a schematic cross-sectional diagram illustrating a configuration example of a negatively-chargeable functional separation multilayer-type electrophotographic photoconductor of the present invention.

FIG. 1 is a schematic cross-sectional diagram illustrating a configuration example of an electrophotographic photoconductor of the present invention. In the negatively-chargeable multilayer-type photoconductor illustrated in the figure, a conductive support 1 has sequentially stacked thereon an undercoat layer 2, and a photoconductive layer made up of a charge generation layer 3 having a charge generation function and a charge transport layer 4 having a charge transport function.

In the electrophotographic photoconductor of the present invention, a highly branched polymer is incorporated, in addition to a charge transport material and a binder resin, into the charge transport layer that is the outermost layer. As a result, it becomes possible to prevent the occurrence of cracks derived from adhesion of human oils, such as sebum, to the photoconductor surface. Cracks on the photoconductor caused by human oils are deemed to arise from the fact that the charge transport material, having eluted in oils from sebum that is adhered to the photoconductor surface, migrates readily in the direction of the sebum on the surface. Voids are generated in the film, and stress concentrates in the voids, giving rise to cracks. By contrast, the highly branched polymer that is used in the present invention has high dispersibility in resins, as described above, and has alicyclic groups; the highly branched polymer is hence highly lipophilic. Accordingly, the highly branched polymer is incorporated into the outermost layer of the photoconductor, segregates as a result at the photoconductor surface, binds to human sebum that is adhered to the surface, and causes the sebum to diffuse in the surface direction; as a result, sebum is prevented from intruding into the photoconductor, and it becomes possible to hinder migration of the charge transport material and so forth into the sebum. The occurrence of cracks on the photoconductor surface, derived from adhesion of sebum, can be prevented as a result. The highly branched polymer according to the present invention can also contribute to enhancing transfer resistance and gas resistance, without detracting from electrical characteristic stability.

In the present invention, it suffices that the above highly branched polymer be incorporated into the charge transport layer, which is the outermost layer of the negatively-chargeable photoconductor. The intended effect of the present invention can be achieved as a result. In the present invention, the presence or absence of other layers, specifically an undercoat layer, is not particularly limited, and can be appropriately determined, as desired.

Conductive Support

The conductive support 1 functions as one electrode of the photoconductor, and, at the same time, constitutes a support of the various layers that make up the photoconductor. The conductive support 1 may take on any shape, for instance cylindrical, plate-like or film-like shape. Materials that can be used as the material of the conductive support 1 include metals such as aluminum, stainless steel, nickel or the like, or a material such as glass, a resin or the like the surface whereof has been subjected to a conductive treatment.

Undercoat Layer

The undercoat layer 2 is a layer having a resin as a main component, or a layer made up of metal oxide coating film of alumite or the like. The undercoat layer 2 is provided, as needed, for the purpose of, for instance, controlling injectability of charge from the conductive support 1 into the photoconductive layer, or for covering defects on the conductive support surface and enhancing adhesion between the photoconductive layer and the conductive support 1. Examples of the resin material that is used in the undercoat layer 2 include, for instance, insulating polymers such as casein, polyvinyl alcohol, polyamide, melamine, cellulose and the like, as well as conductive polymers such as polythiophene, polypyrrole, polyaniline and the like. These resins can be used singly or mixed with each other in appropriate combinations. The resins can contain a metal oxide such as titanium dioxide, zinc oxide or the like.

Charge Generation Layer

The charge generation layer 3, which is formed in accordance with a method that involves, for instance, application a coating solution having particles of a charge generation material dispersed in a binder resin, generates charge when receiving light. High carrier generation efficiency, coupled at the same time with injectability of the generated charge into the charge transport layer 4, is an important issue herein. Preferably, thus, the charge generation layer 3 has little electric field dependence and affords good injection even in low fields.

Examples of the charge generation material that can be used include, for instance, phthalocyanine compounds such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous-type titanyl phthalocyanine, ϵ-type copper phthalocyanine and the like, various azo pigments, anthanthrone pigments, thiapyrylium pigments, perylene pigments, perinone pigments, squarylium pigments, quinacridone pigments and the like, singly or in appropriate combinations. An appropriate substance can be selected herein in accordance with the light wavelength region of the exposure light source that is used in image formation. The charge generation layer 3 has a charge generation material as a main constituent, and can be formed by adding, to the latter, a charge transport material and the like. The charge transport material in that case can be selected, as appropriate, from among the charge transport materials that are used in the below-described charge transport layer.

Binder resins that can be used as the binder resin of the charge generation layer include suitable combinations of polymers and copolymers of, for instance, polycarbonate resins, polyarylate resins, polyester resins, polyamide resins, polyurethane resins, vinyl chloride resins, vinyl acetate resins, phenoxy resins, polyvinyl acetal resins, polyvinyl butyral resins, polystyrene resins, polysulfone resins, diallyl phthalate resins, methacrylate resins and the like.

The content of the charge generation material in the charge generation layer 3 ranges preferably from 20 to 80 mass %, more preferably from 30 to 70 mass %, with respect to the solids in the charge generation layer 3. The content of the binder resin in the charge generation layer 3 ranges preferably from 20 to 80 mass %, more preferably from 30 to 70 mass %, with respect to the solids in the charge generation layer 3.

It suffices that the charge generation layer 3 have a charge generation function; hence, the thickness of the charge generation layer 3 is determined by the light absorption coefficient, and is ordinarily 1 μm or smaller, preferably 0.5 μm or smaller.

Charge Transport Layer

The charge transport layer 4 can be configured mainly out of a charge transport material and a binder resin. The intended effect of the present invention can be elicited by further incorporating, into the charge transport layer 4, the above-described highly branched polymer having a long-chain alkyl group or an alicyclic group.

Specific examples of the monomer (A) being a structural unit of the above highly branched polymer include, for instance, the monomer represented by formula (1) below, and specific examples of the monomer (B) include, for instance, the monomer represented by formula (2) below. The highly branched polymer according to the present invention, however, is not limited to the structures depicted herein.

(1)

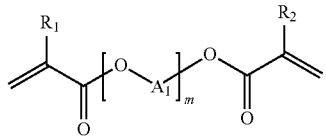

In Formula (1), $R_1$ and $R_2$ represent a hydrogen atom or a methyl group, $A_1$ represents an alicyclic group having 3 to 30 carbon atoms, or an alkylene group having 2 to 12 carbon atoms and optionally substituted with a hydroxy group, and m represents an integer ranging from 1 to 30.

(2)

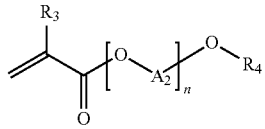

In Formula (2), $R_3$ represents a hydrogen atom or a methyl group, $R_4$ represents an alkyl group having 6 to 30 carbon atoms or an alicyclic group having 3 to 30 carbon atoms, $A_2$ represents an alkylene group having 2 to 6 carbon atoms, and n represents an integer ranging from 0 to 30.

Examples of the alkylene group having 2 to 12 carbon atoms and optionally substituted with a hydroxy group, represented by $A_1$ in Formula (1) above, include, for instance, ethylene groups, trimethylene groups, 2-hydroxytrimethylene groups, methyl ethylene groups, tetramethylene groups, 1-methyl trimethylene groups, pentamethylene groups, 2,2-dimethyl trimethylene groups, hexamethylene groups, nonamethylene groups, 2-methyl octamethylene groups, decamethylene groups, dodecamethylene groups and the like. Specifically, isoprene, butadiene, 3-methyl-1, 2-butadiene, 2,3-dimethyl-1,3-butadiene, 1,2-polybutadiene, pentadiene, hexadiene, octadiene and the like.

Specific examples of the alicyclic group having 3 to 30 carbon atoms represented by $A_1$ in Formula (1) include, for instance, cyclopentadiene, cyclohexadiene, cyclooctadiene, norbornadiene, 1,4-cyclohexanedimethanol di(meth)acrylate, (2-(1-((meth)acryloyloxy)-2-methylpropane-2-yl)-5-ethyl-1,3-dioxane-5-yl)methyl(meth)acrylate, 1,3-adamantanediol di(meth)acrylate, 1,3-adamantanedimethanol di(meth)acrylate, tricyclo[5.2.1.$0^{2,6}$]decanedimethanol di(meth)acrylate, 1,4-cyclohexanedimethanol di(meth)acrylate, (2-(1-((meth)acryloyloxy)-2-methyl propane-2-yl)-5-ethyl-1,3-dioxane-5-yl)methyl (meth)acrylate, 1,3-adamantanediol di(meth)acrylate, 1,3-adamantanedimethanol di(meth)acrylate, tricyclo[5.2.1.$0^{2,6}$]decanedimethanol di(meth)acrylate and the like.

Preferably, the monomer (B) has at least one from among a vinyl group and a (meth)acrylic group.

Examples of the alkyl group having 6 to 30 carbon atoms and represented by $R_4$ in Formula (2) include, for instance, hexyl groups, ethylhexyl groups, 3,5,5-trimethyl hexyl groups, heptyl groups, octyl groups, 2-octyl groups, isooctyl groups, nonyl groups, decyl groups, isodecyl groups, undecyl groups, lauryl groups, tridecyl groups, myristyl groups, palmityl groups, stearyl groups, isostearyl groups, arachidyl groups, behenyl groups, lignoceryl groups, cerotoyl groups, montanyl groups, melissyl groups and the like. The number of carbon atoms in the alkyl group ranges preferably from 10 to 30, and more preferably from 12 to 24. The alkyl group represented by $R_4$ may be linear or branched. Preferably, $R_4$ is a linear alkyl group, in order to impart yet better contamination resistance.

Examples of the alicyclic group having 3 to 30 carbon atoms and represented by $R_4$ in Formula (2) include, for instance, cyclopropyl groups, cyclobutyl groups, cyclopentyl groups, cyclohexyl groups, 4-tert-butyl cyclohexyl groups, isobornyl groups, norbornenyl groups, menthyl groups, adamantyl groups, tricyclo[5.2.1.$0^{2,6}$]decanyl groups and the like.

Examples of the alkylene group having 2 to 6 carbon atoms and represented by $A_2$ in Formula (2) include, for instance, ethylene groups, trimethylene groups, methyl ethylene groups, tetramethylene groups, 1-methyl trimethylene groups, pentamethylene groups, 2,2-dimethyl trimethylene groups, hexamethylene groups and the like.

Preferably, n in Formulas (1) and (2) above is 0, photoconductor contamination resistance.

Examples of such monomer (B) include, for instance, hexyl(meth)acrylate, ethylhexyl(meth)acrylate, 3,5,5-trimethyl hexyl(meth)acrylate, heptyl(meth)acrylate, octyl (meth)acrylate, 2-octyl(meth)acrylate, isooctyl(meth)acrylate, nonyl(meth)acrylate, decyl(meth)acrylate, isodecyl (meth)acrylate, undecyl(meth)acrylate, lauryl(meth) acrylate, tridecyl(meth)acrylate, palmityl(meth)acrylate, stearyl(meth)acrylate, isostearyl(meth)acrylate, behenyl (meth)acrylate, cyclopropyl(meth)acrylate, cyclobutyl (meth)acrylate, cyclopentyl(meth)acrylate, cyclohexyl (meth)acrylate, 4-tert-butyl cyclohexyl(meth)acrylate, isobornyl(meth)acrylate, norbornene(meth)acrylate, menthyl(meth)acrylate, adamantane(meth)acrylate, tricyclo [5.2.1.$0^{2,6}$]decane(meth)acrylate, 2-hexyloxyethyl(meth) acrylate, 2-lauryloxyethyl(meth)acrylate, 2-stearyloxyethyl (meth)acrylate, 2-cyclohexyloxyethyl(meth)acrylate, trimethylene glycol-monolauryl ether-(meth)acrylate, tetramethylene glycol-monolauryl ether-(meth)acrylate, hexamethylene glycol-monolauryl ether-(meth)acrylate, diethylene glycol-monostearyl ether-(meth)acrylate, triethylene glycol-monostearyl ether-(meth)acrylate, tetraethylene glycol-monolauryl ether-(meth)acrylate, tetraethylene glycol-monostearyl ether-(meth)acrylate, hexaethylene glycol-monostearyl ether-(meth)acrylate and the like.

The monomer (B) may be used singly, or in the form of two or more types used concomitantly.

Examples of the azo-based polymerization initiator (C) of the present invention include, for instance, 2,2'-azobisisobutyronitrile, 2,2'-azobis(2-methylbutyronitrile), 2,2'-azobis(2,4-dimethylvaleronitrile), 1,1'-azobis(1-cyclohexane carbonitrile), 2,2'-azobis(4-methoxy-2,4-dimethyl valeronitrile), 2-(carbamoylazo)isobutyronitrile, dimethyl 1,1'-azobis(1-cyclohexane carboxylate) and the like. Preferred among the foregoing are 2,2'-azobis(2,4-dimethyl valeronitrile) and dimethyl 1,1'-azobis(1-cyclohexanecarboxylate) in terms of the surface modification effect on constituent materials and the electrical characteristics that the foregoing afford.

Specifically, the highly branched polymer used in the present invention is obtained by polymerizing the monomer (A) and the monomer (B), in the presence of a predetermined amount of the azo-based polymerization initiator (C) with respect to the monomer (A). In the present invention, the ratio of monomer (A) and monomer (B) during copolymerization of the foregoing ranges preferably from 5 to 300 mol %, more preferably from 10 to 150 mol % of the monomer (B), with respect to the number of moles of the monomer (A). The azo-based polymerization initiator (C) is used preferably in an amount of 5 to 200 mol %, more preferably in an amount of 50 to 100%, with respect to the number of moles of the monomer (A).

Examples of the polymerization method involved include, for instance, known methods such as solution polymerization, dispersion polymerization, precipitation polymerization, bulk polymerization and the like. Preferred among the foregoing is solution polymerization or precipitation polymerization. Particularly preferably, the reaction is carried out by solution polymerization in an organic solvent, from the viewpoint of molecular weight control.

Examples of solvents that are used herein include, for instance, aromatic hydrocarbons such as benzene, toluene, xylene, ethylbenzene, tetralin, o-dichlorobenzene and the like; aliphatic or alicyclic hydrocarbons such as n-hexane, cyclohexane and the like; halides such as methyl chloride, methyl bromide, chloroform and the like; esters or ester ethers such as ethyl acetate, butyl acetate, propylene glycol monomethyl ether acetate, propylene glycol monomethyl ether and the like; ethers such as tetrahydrofuran, 1,4-dioxane, methyl cellosolve and the like; ketones such as acetone, methyl ethyl ketone, methyl isobutyl ketone and the like; alcohols such as methanol, ethanol, n-propanol, isopropanol and the like; amides such as N,N-dimethylformamide, N,N-dimethylacetamide and the like; sulfoxides such as dimethyl sulfoxide and the like; as well as mixed solvents comprising two or more types of the foregoing. The amount of organic solvent can be set to 1 to 100 parts by mass with respect to 1 part by mass of the monomer (A).

The temperature during polymerization is 50 to 200° C.; more preferably, polymerization is carried out at a temperature that is higher by 20° C. or more than the 10-hour half life temperature of the azo-based polymerization initiator (C). After polymerization, the obtained highly branched polymer may be recovered in accordance with any method, such as re-precipitation in a poor solvent, precipitation or the like.

Examples of the highly branched polymer used in the present invention include, specifically, the highly branched polymers 1 to 16 and 18 to 36 described in the specification of WO 2012/128214. The polystyrene-equivalent molecular weight, measured by gel permeation chromatography, of the highly branched polymer used in the present invention ranges preferably from 1000 to 200000, more preferably from 2000 to 100000 and yet more preferably from 5000 to 60000.

The highly branched polymer used in the present invention is a so-called hyperbranched polymer, and has a dendritic structure that is highly branched, as that of dendrimers. As a characterizing feature of the highly branched polymer, however, branching in the latter yields an incomplete dendritic structure in which not all branching sites undergo polymerization, as in dendrimers. The degree of branching of the highly branched polymer can be generally estimated on the basis of respective quantities of terminal sites, branching sites and non-branching sites, and can be inferred by working out the rotation radius of a resin, by combining gel permeation chromatography (GPC) with light-scattering measurements. When the highly branched polymer and a linear or comb-like polymer of identical molecular weight, and synthesized using identical starting materials, are compared on the basis of molecular weight by GPC and the viscosity of a solution of the polymer dissolved in a solvent, it is found that, ordinarily, the highly branched polymer exhibits characteristically low viscosity thanks to a low degree of molecule entanglement, since the highly branched polymer takes on a spherical structure, and exhibits a long elution time in GPC, on account of the small rotation radius of the highly branched polymer; i.e. the molecular weight as measured by GPC is low.

Examples of the charge transport material of the charge transport layer include, for instance, hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazole, polysilane and the like. The foregoing can be used in the form of one single type, or in suitable combinations of two or more types.

Examples of the binder resin of the charge transport layer that can be used include, for instance, various polycarbonate resins such as a bisphenol A or bisphenol Z polycarbonate, or bisphenol A-biphenyl copolymers, bisphenol Z-biphenyl copolymers and the like, polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resin, polyacetal resin, polyarylate resin, polysulfone resins, and polymers and copolymers of methacrylic acid esters. Similar resins of dissimilar molecular weight can be used in the form of resin mixtures.

The content of the charge transport material in the charge transport layer 4 ranges preferably from 10 to 90 mass %, more preferably from 20 to 80 mass %, and yet more preferably from 30 to 60 mass %, with respect to the solids of the charge transport layer 4. The content of the binder resin in the charge transport layer 4 ranges preferably from 10 to 90 mass %, more preferably from 20 to 80 mass %, with respect to the solids of the charge transport layer 4. The ratio of highly branched polymer comprised in the charge transport layer 4 ranges preferably from 0.01 to 10.00 mass %, more preferably from 0.1 to 8.0 mass %.

In order to secure an effective surface potential in practice, the thickness of the charge transport layer 4 ranges preferably from 3 to 50 μm, more preferably from 15 to 40 μm.

In addition to the foregoing, an antioxidant or deterioration inhibitor such as a light stabilizer or the like can incorporated into the photoconductive layer for the purpose of enhancing environmental resistance and stability towards harmful light. An antioxidant or deterioration inhibitor such as a light stabilizer or the like can incorporated into the photoconductive layer for the purpose of enhancing environmental resistance and stability towards harmful light, as desired. Compounds used for such purposes include, for instance, chromanol derivatives such as tocopherol, as well as ester compounds, polyarylalkane compounds, hydroquinone derivatives, ether compounds, diether compounds, benzophenone derivatives, benzotriazole derivatives, thioether compounds, phenylenediamine derivatives, phosphonate esters, phosphite esters, phenol compounds, hindered phenol compounds, linear amine compounds, cyclic amine compounds, hindered amine compounds and the like.

Into the photoconductive layer, a leveling agent, such as a silicone oil or fluorine-based oil, can be incorporated for the purpose of enhancing leveling in the formed film and/or imparting lubricity. Microparticles of a metal oxide such as silicon oxide (silica), titanium oxide, zinc oxide, calcium oxide, aluminum oxide (alumina), zirconium oxide or the like, or of a metal sulfate such as barium sulfate, calcium sulfate or the like, or of a metal nitride such as silicon nitride, aluminum nitride or the like, fluorine-based resin particles such as polytetrafluoroethylene, and comblike graft polymerization resins or the like may be further incorporated with a view to, for instance, adjusting film hardness, lowering the coefficient of friction and imparting lubricity. Other known additives can be further incorporated, as needed, so long as electrophotographic characteristics are not significantly impaired thereby.

A characterizing feature of the method for producing a photoconductor of the present invention is the use of a coating solution that contains the highly branched polymer according to the present invention, as a coating solution for the charge transport layer, as the outermost layer to produce an electrophotographic photoconductor that comprises at least a charge generation layer and a charge transport layer, in this order, on a conductive support. As a result, it becomes possible to obtain a photoconductor that has excellent surface contamination resistance, stable electrical characteristics and so forth upon repeated use, and superior transfer resistance and gas resistance. Other details of the production process, solvents used to produce the coating solution, among other features, are not particularly limited, and can be determined as appropriate, according to conventional methods. For instance, the coating solution in the production method of the present invention is not limited to any given coating method, and can be used in various coating methods such as dip coating and spray coating.

Electrophotographic Apparatus

The electrophotographic photoconductor of the present invention affords intended effects by being used in various machine processes. Specifically, sufficient effects can be elicited in a charging process, for instance, a contact charging scheme relying on rollers or brushes, a contactless charging scheme relying on a charging member such as a corotron, scorotron or the like, and in a development process, for instance contact development and contactless development schemes (developers) relying on non-magnetic single-component development, magnetic single-component development, and two-component development.

Figure 2:
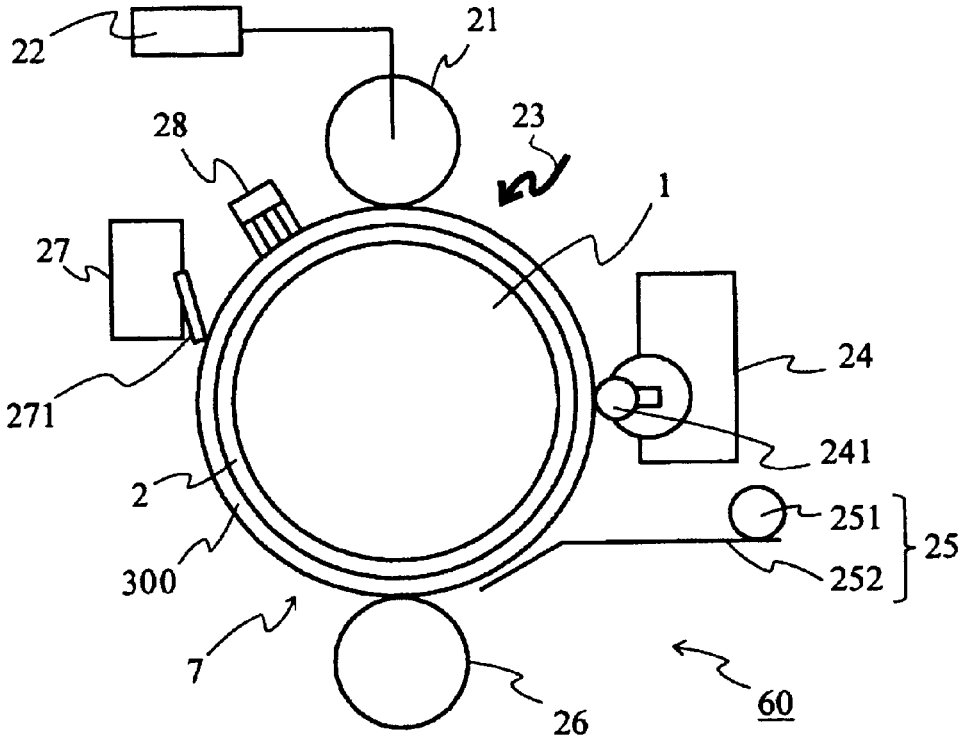
FIG. 2 is a schematic configuration diagram illustrating a configuration example of an electrophotographic apparatus of the present invention.

As an example, FIG. 2 shoes an example of a schematic configuration diagram of the electrophotographic apparatus of the present invention. An electrophotographic apparatus 60 of the present invention is equipped with a electrophotographic photoconductor 7 of the present invention that comprises a conductive support 1, an undercoat layer 2 that covers the outer peripheral face of the conductive support 1, and a photoconductive layer 300. The electrophotographic apparatus 60 is further provided with at least a charging process and a development process. The electrophotographic apparatus 60 is made up of: a roller charging member 21 that is disposed on the outer peripheral edge of the photoconductor 7; a high-voltage power source 22 that supplies applied voltage to the roller charging member 21; an image exposure member 23; a developing device 24 comprising a developing roller 241; a paper feed member 25 comprising a paper feed roller 251 and a paper feed guide 252; a transfer charger (of direct charging type) 26; a cleaning device 27 comprising a cleaning blade 271; and a charge removing member 28. The electrophotographic apparatus 60 of the present invention can be used as a color printer.

EXAMPLES

Specific embodiments of the present invention will be explained next in further detail with reference to examples. So long as the gist of the present invention is not departed from, the scope of the invention is not limited to these examples.

Example 1

Herein, 3 parts by mass of alcohol-soluble nylon (product name "CM8000", by Toray Industries Co., Ltd.) and 7 parts by mass of titanium oxide microparticles treated with aminosilane were dissolved and dispersed in 90 parts by mass of methanol, to prepare an undercoat layer coating solution. The outer periphery of an aluminum-made cylinder having an outer diameter of 30 mm, as the conductive support 1, was dip-coated with the undercoat layer coating solution, with drying for 30 minutes at a temperature of 120° C., to form an undercoat layer 2 having a thickness of 1 μm.

Then 1 part by mass of Y-type titanyl phthalocyanine, as a charge generation material, and 1.5 parts by mass of a polyvinyl butyral resin (product name "S-LEC KS-1", by Sekisui Chemical Co., Ltd.), were dissolved and dispersed in 60 parts by mass of dichloromethane, to prepare a charge generation layer coating solution. The above undercoat layer 2 was dip-coated in the charge generation layer coating solution, with drying for 30 minutes at a temperature of 80° C., to form the charge generation layer 3 having a thickness of 0.25 μm.

Synthesizing a Highly Branched Polymer

A highly branched polymer was synthesized in accordance with the below-described method disclosed in the specification of WO 2012/128214. Specifically, 53 g of toluene were placed in a 200-ml flask with nitrogen influx and the temperature was raised to 110° C. under reflux, with stirring for 5 minutes or longer. Then, 6.6 g (20 mmol) of tricyclo[5.2.1.02,6]decanedimethanol di(meth)acrylate, as the monomer (A), 2.4 g (10 mmol) of lauryl acrylate, as the monomer (B), 3.0 g (12 mmol) of 2,2'-azobis(2,4-dimethyl valeronitrile), as the initiator (C), and 53 g of toluene were placed in a separate 100-ml flask, and the flask was ice-cooled down to 0° C., with nitrogen influx, under stirring.

The solution in the 100-ml flask was dripped, over 30 minutes, onto the toluene in the 200-ml flask. Once dripping was over, the flask was stirred for one hour. Then 80 g of toluene were evaporated and distilled off the reaction solution under reduced pressure. Thereafter, the resulting product was added to 330 g hexane/ethanol (mass ratio 1:2), to elicit precipitation. The resulting liquid was vacuum-filtered and vacuum-dried, to yield 6.4 g of a polymer in the form of a white powder (highly branched polymer 1, described in the specification of WO 2012/128214). The polystyrene-equivalent molecular weight of the polymer when measured in accordance with the GPC measurement method disclosed in the specification of WO 2012/128214 was Mw=7800.

Then, 100 parts by mass of a compound represented by the formula below, as a charge transport material,

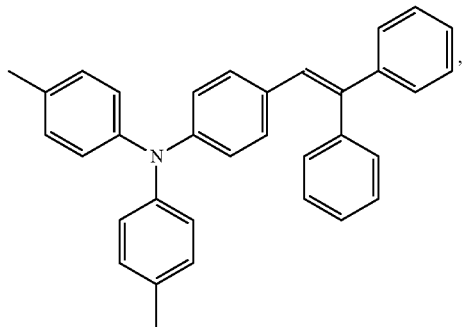

100 parts by mass of a copolymerized polycarbonate resin having a molecular weight of 50000 and having a structure represented by the formula below, as a binder resin,

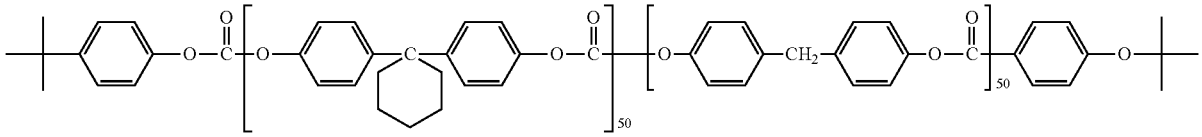

and 5 parts by mass of the highly branched polymer 1 were dissolved in 1000 parts by mass of dichloromethane, to prepare a charge transport layer coating solution. The above charge generation layer 3 was dip-coated in the charge transport layer coating solution, with drying for 60 minutes at a temperature of 90° C., to form the charge transport layer 4 having a thickness of 25 μm, and prepare a negatively-chargeable multilayer-type photoconductor.

Example 2

A photoconductor was produced in accordance with the same method as in Example 1, but herein the highly branched polymer 1 used in Example 1 was changed to the highly branched polymer 2 described in the specification of WO 2012/128214. The Mw of the highly branched polymer 2 was 13,000.

Example 3

A photoconductor was produced in accordance with the same method as in Example 1, but herein the highly branched polymer 1 used in Example 1 was changed to the highly branched polymer 3 described in the specification of WO 2012/128214. The Mw of the highly branched polymer 3 was 10,000.

Example 4

A photoconductor was produced in accordance with the same method as in Example 1, but herein the highly branched polymer 1 used in Example 1 was changed to the highly branched polymer 4 described in the specification of WO 2012/128214. The Mw of the highly branched polymer 4 was 8,200.

Example 5

A photoconductor was produced in accordance with the same method as in Example 1, but herein the highly branched polymer 1 used in Example 1 was changed to the highly branched polymer 6 described in the specification of WO 2012/128214. The Mw of the highly branched polymer 6 was 11,000.

Example 6

A photoconductor was produced in accordance with the same method as in Example 1, but herein the highly branched polymer 1 used in Example 1 was changed to the highly branched polymer 8 described in the specification of WO 2012/128214. The Mw of the highly branched polymer 8 was 10,000.

Example 7

A photoconductor was produced in accordance with the same method as in Example 1, but herein the highly branched polymer 1 used in Example 1 was changed to the highly branched polymer 9 described in the specification of WO 2012/128214. The Mw of the highly branched polymer 9 was 6,600.

Example 8

A photoconductor was produced in accordance with the same method as in Example 1, but herein the highly branched polymer 1 used in Example 1 was changed to the highly branched polymer 10 described in the specification of WO 2012/128214. The Mw of the highly branched polymer 10 was 13,000.

Example 9

A photoconductor was produced in accordance with the same method as in Example 1, but herein the highly branched polymer 1 used in Example 1 was changed to the highly branched polymer 26 described in the specification of WO 2012/128214. The Mw of the highly branched polymer 26 was 9,500.

Example 10

A photoconductor was produced in accordance with the same method as in Example 1, but herein the highly branched polymer 1 used in Example 1 was changed to the highly branched polymer 27 described in the specification of WO 2012/128214. The Mw of the highly branched polymer 27 was 8,800.

Example 11

A photoconductor was produced in accordance with the same method as in Example 1, but herein the addition amount of the highly branched polymer 1 used in Example 1 was changed to 1 part by mass.

Example 12

A photoconductor was produced in accordance with the same method as in Example 1, but herein the addition amount of the highly branched polymer 1 used in Example 1 was changed to 10 part by mass.

Example 13

A photoconductor was produced in accordance with the same method as in Example 1, but herein the charge transport agent used in Example 1 was changed to a charge transport agent having the structure represented by the formula below.

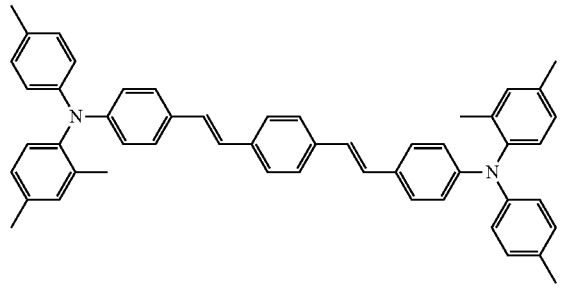

Example 14

A photoconductor was produced in accordance with the same method as in Example 1, but herein the polycarbonate resin used in Example 1 was changed to a resin having a molecular weight 50000 and having the structure represented by the formula below.

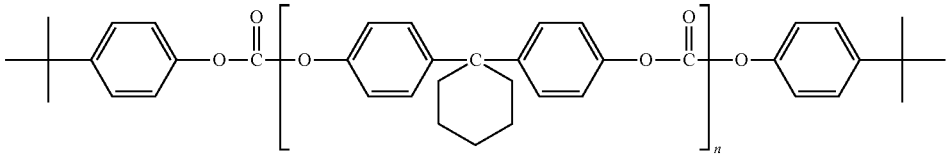

Comparative Example 1

A photoconductor was produced in accordance with the same method as in Example 1, but herein the charge transport layer coating solution was produced without using the highly branched polymer of Example 1.

Comparative Example 2

A photoconductor was produced in accordance with the same method as in Example 13, but herein the charge transport layer coating solution was produced without using the highly branched polymer of Example 13.

Comparative Example 3

A photoconductor was produced in accordance with the same method as in Example 14, but herein the charge transport layer coating solution was produced without using the highly branched polymer of Example 14.

Photoconductor Evaluation

The electrical characteristics, actual-equipment characteristic, transfer resistance and contamination resistance of the photoconductors produced in Examples 1 to 14 and Comparative Examples 1 to 3 were evaluated in accordance with the methods described below. The results are given in the Table.

Electrical Characteristics

The electrical characteristics of each photoconductor produced in the examples and the comparative examples were evaluated in accordance with the method below, using a using a process simulator (CYNTHIA 91) by Gen-Tech, Inc.

Firstly, the photoconductor surface was charged to −800 V through corona discharge by a scorotron charging device, in the dark, and then the surface potential V0 immediately after charging was measured. Next, charging was discontinued, the photoconductor was left to stand in the dark for 5 seconds, the surface potential V5 was measured, and a potential retention rate Vk5 (%) after 5 seconds from charging, defined in Expression (i) below, was worked out:

$$Vk5=(V5/V0)\times 100 \quad (i).$$

With a halogen lamp as a light source, exposure light resolved to 780 nm using a filter was irradiated next onto the photoconductor for 5 seconds, from the point in time at which at which the surface potential reached −800 V. The exposure amount required for light attenuation until the surface potential reached −100 V was worked out as sensitivity E100 ($\mu Jcm^{-2}$), and the residual potential of the photoconductor surface 5 seconds after exposure was worked out as Vr5 (V).

Actual-Equipment Characteristic

Next, each photoconductor produced in the examples and the comparative examples was set in a monochrome laser printer ML-2241 (by Samsung Electronics Co., Ltd.) remodeled so as to enable measurement of the surface potential of the photoconductor. As an initial evaluation there was evaluated the image memory after printing of three solid white prints and three solid black prints under various environments (LL (low-temperature, low-humidity): 10° C. and 15% RH; NN (normal temperature, normal humidity): 25° C. and 50% RH; and HH (high-temperature, high-humidity): 35° C. and 85% RH). Image memory evaluation involved reading a memory phenomenon wherein, upon printing evaluation of an image sample imparted with a checkered flag pattern on a first-half portion and with a halftone on a second-half portion of scanner sweep, the checkered flag becomes reflected on the halftone portion. Acceptability was determined on the basis of the intensity of the reflected checkered flag (ⓧ: very good, ○ good, Δ: light memory, ×: heavy memory).

The variation amount of surface potential at charging V0 and bright area potential VL, as well as image memory, before and after printing of 10,000 prints in a normal temperature, normal humidity environment (25° C. 50% RH), were likewise evaluated. Image memory was evaluated in accordance with the same criteria as described above.

Transfer Resistance

Figure 3:
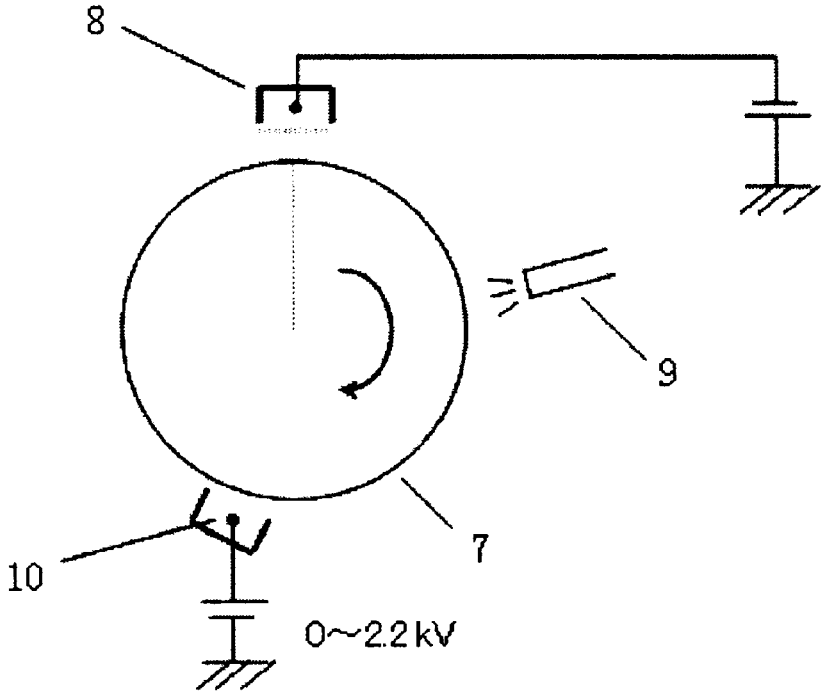
FIG. 3 is a schematic explanatory diagram illustrating the configuration of a device that is used for evaluating transfer resistance in examples.

Transfer resistance was evaluated using a commercially available multi-function printer (1600n, by Dell Inc.) illustrated in FIG. 3, remodeled so as to enable observation of the surface potential of the photoconductor 7. Specifically, seven solid white prints were printed using the printer having each respective photoconductor built thereinto, with 0 kV (first print), and 1.2 kV (second print) to 2.2 kV (seventh print) being applied step-wise to a transfer pole 10 by a high-voltage power source, under constant-voltage control. Printing was carried out under various environments (LL (low-temperature, low-humidity): 10° C. and 15% RH and NN (normal temperature, normal humidity): 25° C. and 50% RH), and acceptability pertaining to transfer resistance was determined to be good for a small ΔV, where ΔV=V1 (dark area potential between prints for first print)−V7 (dark area potential for seventh print). In FIG. 3, the reference symbol 8 denotes a charging device (a charger) and the reference symbol 9 denotes an exposure light source.

Contamination Resistance

Resistance to Fatty Acids

A wiper (BEMCOT M-311, by Asahi Kasei Fibers Corp.), cut to 10 mm square and impregnated with 80 to 120 mg of oleic acid triglyceride (by Wako Pure Chemical Industries, Ltd.) was brought into contact for 24 hours with the surface of each photoconductor of the examples and comparative examples, under conditions identical to those of the evaluation of the actual-equipment characteristic above. The wiper was then removed, and the photoconductor surface was wiped off. Thereafter, a halftone image of a 1-on-2-off pattern was printed, and the presence or absence of printing defects (white spot defects and black spot defects) at the attachment portion was checked. Instances of streaks present on the images were rated as ○, and absence as ×.

Resistance to Oil Contamination Caused by Human Scalp

Herein, 30 small pieces of human scalp (about 0.5 mm square) were affixed to the photoconductor surface, and were left to stand for 10 days in an environment at 25° C. and 50RH %. Thereafter, a halftone image of a 1-on-2-off pattern was printed using the above monochrome laser printer, and the resulting presence or absence of printing defects (white spot defects and black spot defects) at the scalp-adhered portions was assessed. Instances of 0 sites with image defects, from among the 30 sites, were rated as ○ (good), instances of 1 to 3 sites were rated as Δ (fair), and instances of 4 or more sites were rated as × (poor).

Ozone Resistance

Each photoconductor of the examples and the comparative examples was exposed to 100 ppm of ozone, for 2 hours, by being left to stand inside an ozone exposure apparatus in which photoconductors can be left to stand in an ozone atmosphere. The potential retention rate Vk5 was measured under conditions identical to those of the electrical characteristic test above, and the degree of change of retention rate Vk5 before and after ozone exposure was worked out, to determine an ozone exposure retention rate of change (ΔVk5) as a percentage. The ozone exposure retention rate of change was worked out according to the expression below, where $Vk5_1$ denotes the retention rate before ozone exposure and $Vk5_2$ denotes the retention rate after ozone exposure:

$$\Delta Vk5 = Vk5_2(\text{after ozone exposure})/Vk5_1(\text{before ozone exposure}).$$

TABLE 1

| | Actual-equipment characteristic | | | | | | | | | | | | |
|---|---|---|---|---|---|---|---|---|---|---|---|---|---|
| | Electrical characteristic | | | Printing evaluation (initial) Memory characteristic | | | Printing evaluation (after 10000 prints) | | | Transfer resistance 25° C. | Contamination resistance test | | |
| | | | | 35° C. | 25° C. | 10° C. | | Potential variation | | 50% (NN) | Resistance to fatty acids | Resistance to oil contamination | Ozone resistance |
| | Vk5 (%) | E100 ($\mu Jcm^{-2}$) | Vr5 (−V) | 85% RH (HH) | 50% RH (NN) | 15% RH (LL) | Memory characteristic | ΔV (V) | ΔVL (−V) | ΔV (−V) | | | ΔVk5 (%) |
| Example 1 | 96.1 | 0.26 | 27 | ⊗ | ⊗ | ⊗ | ⊗ | 6 | 5 | 30 | ○ | ○ | 1.80 |
| Example 2 | 96.5 | 0.28 | 28 | ⊗ | ⊗ | ⊗ | ○ | 8 | 3 | 26 | ○ | ○ | 1.50 |
| Example 3 | 96.4 | 0.27 | 28 | ⊗ | ⊗ | ⊗ | ○ | 7 | 2 | 25 | ○ | ○ | 1.80 |
| Example 4 | 96.3 | 0.28 | 30 | ⊗ | ⊗ | ○ | ○ | 9 | 1 | 27 | ○ | ○ | 1.20 |
| Example 5 | 96.8 | 0.27 | 29 | ⊗ | ⊗ | ○ | ⊗ | 9 | 2 | 29 | ○ | ○ | 2.20 |
| Example 6 | 96.5 | 0.28 | 32 | ⊗ | ⊗ | ○ | ○ | 8 | 2 | 30 | ○ | ○ | 1.70 |
| Example 7 | 96.4 | 0.27 | 30 | ⊗ | ⊗ | ○ | ○ | 7 | 5 | 32 | ○ | ○ | 1.90 |
| Example 8 | 96.3 | 0.28 | 28 | ⊗ | ⊗ | ○ | ○ | 9 | 6 | 31 | ○ | ○ | 1.40 |
| Example 9 | 96.8 | 0.27 | 29 | ⊗ | ⊗ | ○ | ⊗ | 8 | 8 | 29 | ○ | ○ | 1.30 |
| Example 10 | 96.8 | 0.27 | 31 | ⊗ | ⊗ | ○ | ⊗ | 8 | 3 | 34 | ○ | ○ | 1.40 |
| Example 11 | 96.8 | 0.27 | 28 | ⊗ | ⊗ | ○ | ⊗ | 8 | 2 | 36 | ○ | ○ | 1.20 |
| Example 12 | 96.8 | 0.27 | 26 | ⊗ | ⊗ | ○ | ⊗ | 8 | 2 | 26 | ○ | ○ | 2.50 |
| Example 13 | 96.8 | 0.20 | 19 | ⊗ | ⊗ | ○ | ⊗ | 8 | 1 | 34 | ○ | ○ | 3.00 |
| Example 14 | 95.6 | 0.26 | 35 | ⊗ | ⊗ | ○ | ○ | 5 | 2 | 40 | ○ | ○ | 1.80 |
| Comp. Ex. 1 | 95.5 | 0.32 | 45 | ○ | ○ | Δ | ○ | 12 | 20 | 55 | X | Δ | 4.20 |
| Comp. Ex. 2 | 95.6 | 0.22 | 21 | ○ | ⊗ | Δ | ○ | 15 | 25 | 59 | X | Δ | 4.40 |
| Comp. Ex. 3 | 95.6 | 0.35 | 44 | ○ | ⊗ | Δ | ○ | 15 | 25 | 59 | X | Δ | 4.40 |

The above results in the table revealed that the initial electrical characteristics in the examples, where the highly branched polymer according to the present invention was used, boasted higher sensitivity and lower residual potential than in the case of Comparative Examples 1 and 3. It was found that there was virtually no observable variation in initial sensitivity, arising from the use of the highly branched polymer according to the present invention, versus Comparative Examples 1 to 3 in which the highly branched polymer according to the present invention was not added.

Accordingly, the results in the table revealed that photoconductors where the highly branched polymer according to the present invention was used exhibited good initial electrical characteristics and potential characteristics in various environments, and smaller potential change during endurance printing, while good contamination resistance was achieved at the same time.

It was found, from all the above, that using the highly branched polymer according to the present invention allows obtaining an electrophotographic photoconductor that has excellent contamination resistance and stable electrical characteristics and so forth upon repeated use, as well as superior transfer resistance and gas resistance.

What is claimed is:

1. An electrophotographic photoconductor, comprising:

a conductive support;

a charge generation layer provided on the conductive support; and a charge transport layer containing a charge transport material, a binder resin, and a highly branched polymer having a long-chain alkyl group or an alicyclic group, provided on the charge generation layer as an outermost layer.

2. The electrophotographic photoconductor according to claim 1, wherein the highly branched polymer is obtained by polymerizing a monomer (A) and a monomer (B) in the presence of an azo-based polymerization initiator (C), the monomer (A) having, in a molecule, two or more radically polymerizable double bonds, and the monomer (B) having, in a molecule, an alkyl group having 6 to 30 carbon atoms or an alicyclic group having 3 to 30 carbon atoms, and at least one radically polymerizable double bond.

3. The electrophotographic photoconductor according to claim 2, wherein the monomer (A) has a structure represented by Formula (1) below and the monomer (B) has a structure represented by Formula (2) below:

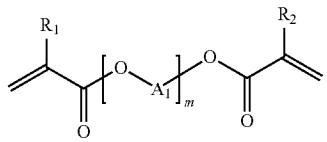

(1)

where, in Formula (1), $R_1$ and $R_2$ represent a hydrogen atom or a methyl group, $A_1$ represents an alicyclic group having 3 to 30 carbon atoms, or an alkylene group having 2 to 12 carbon atoms and optionally substituted with a hydroxy group, and m represents an integer ranging from 1 to 30, (2)

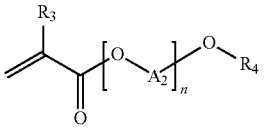

where, in Formula (2), $R_3$ represents a hydrogen atom or a methyl group, $R_4$ represents an alkyl group having 6 to 30 carbon atoms or an alicyclic group having 3 to 30 carbon atoms, $A_2$ represents an alkylene group having 2 to 6 carbon atoms, and n represents an integer ranging from 0 to 30.

4. The electrophotographic photoconductor according to claim 2, wherein the azo-based polymerization initiator (C) is 2,2'-azobis(2,4-dimethyl valeronitrile) or dimethyl 1,1'-azobis(1-cyclohexanecarboxylate).

5. The electrophotographic photoconductor according to claim 1, wherein the highly branched polymer has a polystyrene-equivalent molecular weight, as measured by gel permeation chromatography, that ranges from 1000 to 200000.

6. A method for producing an electrophotographic photoconductor according to claim 1, the method comprising:

providing a coating solution for the charge transport layer containing the charge transport material, the binder resin and the highly branched polymer having a long-chain alkyl group or an alicyclic group; and coating the coating solution onto the charge generation layer.

7. An electrophotographic apparatus, which is equipped with the electrophotographic photoconductor according to claim 1.

8. The electrophotographic apparatus according to claim 7, further comprising a charging device and a developing device.

* * * * *